US007047567B2

(12) United States Patent
Allen

(10) Patent No.: US 7,047,567 B2
(45) Date of Patent: May 23, 2006

(54) TURNOUT COAT AND PANTS WITH BUILT-IN HARNESS

(76) Inventor: Douglas L. Allen, 1500 Park Ave., Hoboken, NJ (US) 07030

( * ) Notice: Subject to any disclaimer, the term of this patent is extended or adjusted under 35 U.S.C. 154(b) by 425 days.

(21) Appl. No.: 10/099,011

(22) Filed: Mar. 14, 2002

(65) Prior Publication Data

US 2003/0172431 A1 Sep. 18, 2003

(51) Int. Cl.
*A41D 13/00* (2006.01)

(52) U.S. Cl. ..... 2/69

(58) Field of Classification Search ..... 2/304, 2/102, 69, 79, 81, 93, 108, 92, 44, 94, 97, 2/456, 307–310, 312, 69.5, 70; 182/3–6, 182/11; 244/151 R, 138 R, 142–143
See application file for complete search history.

(56) References Cited

U.S. PATENT DOCUMENTS

| | | | | |
|---|---|---|---|---|
| 1,172,615 | A | 2/1916 | Lelansky | |
| 1,183,511 | A | 5/1916 | Adams | |
| 2,979,153 | A | 4/1961 | Hoagland et al. | |
| 3,176,793 | A | 4/1965 | Hlacia | |
| 3,498,408 | A | 3/1970 | Foote | |
| 3,973,643 | A | 8/1976 | Hutchinson | |
| 4,449,253 | A | 5/1984 | Hettinger | |
| 4,625,335 | A | 12/1986 | Vinai | |
| 5,036,548 | A | 8/1991 | Grilliot et al. | |
| 5,095,549 | A | 3/1992 | Aldridge | |
| 5,136,724 | A | 8/1992 | Grilliot et al. | |
| 5,188,267 | A | 2/1993 | Sargent et al. | |
| 5,267,352 | A | 12/1993 | Rodarmel | |
| 5,289,590 | A | 3/1994 | Larson | |
| 5,450,627 | A | 9/1995 | Grilliot et al. | |
| 5,548,843 | A | 8/1996 | Chase et al. | |
| 5,738,046 | A | 4/1998 | Williams et al. | |
| 5,884,332 | A | 3/1999 | Snedeker | |
| 5,970,517 | A | 10/1999 | Jordan | |
| 6,101,631 | A | 8/2000 | Ferguson, Jr. | |
| 6,105,169 | A | 8/2000 | Colorado | |
| 6,637,547 | B1 * | 10/2003 | Wydner | 182/3 |
| 6,658,666 | B1 * | 12/2003 | Schweer | 2/94 |

* cited by examiner

*Primary Examiner*—Tejash Patel
(74) *Attorney, Agent, or Firm*—Lerner, David, Littenberg, Krumholz & Mentlik, LLP

(57) ABSTRACT

Safety clothing comprising a turnout coat and pants with a built in harness is disclosed. The harness may be attached to the exterior or interior of the coat and pants. The harness is adjustable to snuggly fit the wearer. The harness further attaches the coat to the pant. A wearer of the coat and pants may connect the harness at various locations to a safety line.

43 Claims, 5 Drawing Sheets

TURNOUT COAT AND PANTS WITH BUILT-IN HARNESS

FIELD OF THE INVENTION

This invention relates to protective clothing. More particularly, this invention relates to a turnout coat and pants having a permanently attached and versatile safety harness.

BACKGROUND OF THE INVENTION

Firefighters typically wear protective clothing comprising a turnout coat and pants. Such clothing is made of stiff fire retardant material. Firefighters also typically use equipment such as a safety harness, which is typically worn separate from the protective clothing. Safety harnesses are used, for example, to allow a firefighter to repel and to lift an injured firefighter from a lower floor.

The prior art has attempted to integrate a harness with protective clothing, especially for use by firefighters. For example, U.S. Pat. No. 3,973,643 to Hutchinson is drawn to a detachable harness for a fireman's coat. The harness is adapted to fit about the torso of the wearer and is releasably attached to the inside of the knee-length turnout coat. Hutchinson fails to disclose a safety harness attached to both the turnout coat and turnout pants. Moreover, the detachability of the harness does not provide the durability and strength of a harness permanently attached to the protective clothing. Similarly, in U.S. Pat. No. 5,970,517, Jordan discloses a harness secured within a coat having a front opening through which the support line is passed.

In U.S. Pat. No. 4,625,335 to Vinai, a safety harness is attached to single piece coverall covering the entire body. Such a single piece garment is not feasible for use by firemen, as it cannot be quickly put on.

U.S. Pat. No. 5,289,590 to Larson discloses combined trousers and safety harness wherein the harness is attached inside the trousers but must be maintained in its readiness position for dressing. The harness is merely attached to the pants and would be difficult to dress in if the interior portion of the harness is not in its readiness position. Similarly, U.S. Pat. No. 6,105,169 to Colorado shows a harness strap assembly incorporated into the inner liner of the pants.

In U.S. Pat. No. 5,036,548 to Grilliot et al., firefighter's pants are equipped with connectors to which a safety harness may be connected.

The prior art fails to show a combined turnout coat and turnout pants having a single safety harness securely fastened to both. Such a combination is desirable because it increases the durability and security of the harness since it is attached to the two separate articles of clothing, i.e., the coat and pants. Moreover, the separate pieces may be quickly and easily worn by a firefighter in the emergent situations typical in the firefighting field, and a firefighter can always be totally prepared with a safety harness on his or her everyday turnout gear.

SUMMARY OF THE INVENTION

The invention comprises a combination turnout coat and turnout pants having a safety harness attached thereto. The safety harness is permanently attached to the coat and pants. The harness comprises connectors that attach the coat and the pants, and thus the components of the harness, to each other. In addition, there are connectors on the harness to connect the harness to a safety line and attachments for carrying equipment. The invention provides a harness that is stronger and sturdier than the harness of the prior art, and fosters versatility without impinging on the comfort of everyday turnout gear. Moreover, the present invention may be quickly and easily put on and fastened by a firefighter. The invention provides a firefighter with preparedness just by wearing the turnout gear without the need for additional equipment. Additionally, an injured or unconscious firefighter wearing the turnout gear of the present invention may be readily attached to a safety line for rescue, saving time in a life-threatening situation.

In accordance with one aspect of the invention, protective clothing comprising a turnout coat, turnout pants, and a safety harness attached to the coat and pants is provided. The safety harness includes an upper portion attached to the coat, a lower portion attached to the pants, and a connector for connecting safety lines or other rescue and safety equipment thereto. In addition, another person wearing a harness may be attached to the connector. The upper and lower portions of the harness are connectable. The harness may further include an attachment for attaching devices, and safety equipment such as flashlights, or repelling.

The size of the safety harness may be adjusted via adjustable straps so that the harness properly fits the wearer. The upper portion of the harness includes first and second upper straps attached to the coat from the front shoulder area to the front waist area and from an upper back area to a lower back area. The lower portion of the harness includes first and second leg straps attached to a leg of said pants at a front and back upper thigh area. The leg straps may me adjustable. Additionally, the upper portion includes an upper back strap and a lower back strap.

In accordance with another aspect of the invention, the connector may be D rings attached at various locations to the harness. According to one embodiment, a D ring is attached to said upper back strap and another D ring is attached to one of the adjustable straps. Thus, a safety line may be attached to the D ring attached to the adjustable strap or the D ring attached to the back strap.

According to another aspect of the invention, the attachment for safety equipment may be a D ring attached to the side of the coat.

According to yet another aspect, the protective clothing further includes a pocket for storing the safety line. The pocket may be partially releasably attached to the coat. According to one embodiment, the pocket includes one edge permanently attached to the coat and two edges releasably attached to the coat. The fourth edge may be releasably attached to the coat, or may be completely unattached to the coat.

Moreover, in accordance with another aspect of the invention, the safety harness is permanently attached to said coat and said pants. In addition, at least a portion of the harness may be attached to the interior of the coat.

DETAILED DESCRIPTION OF THE INVENTION

Figure 1:
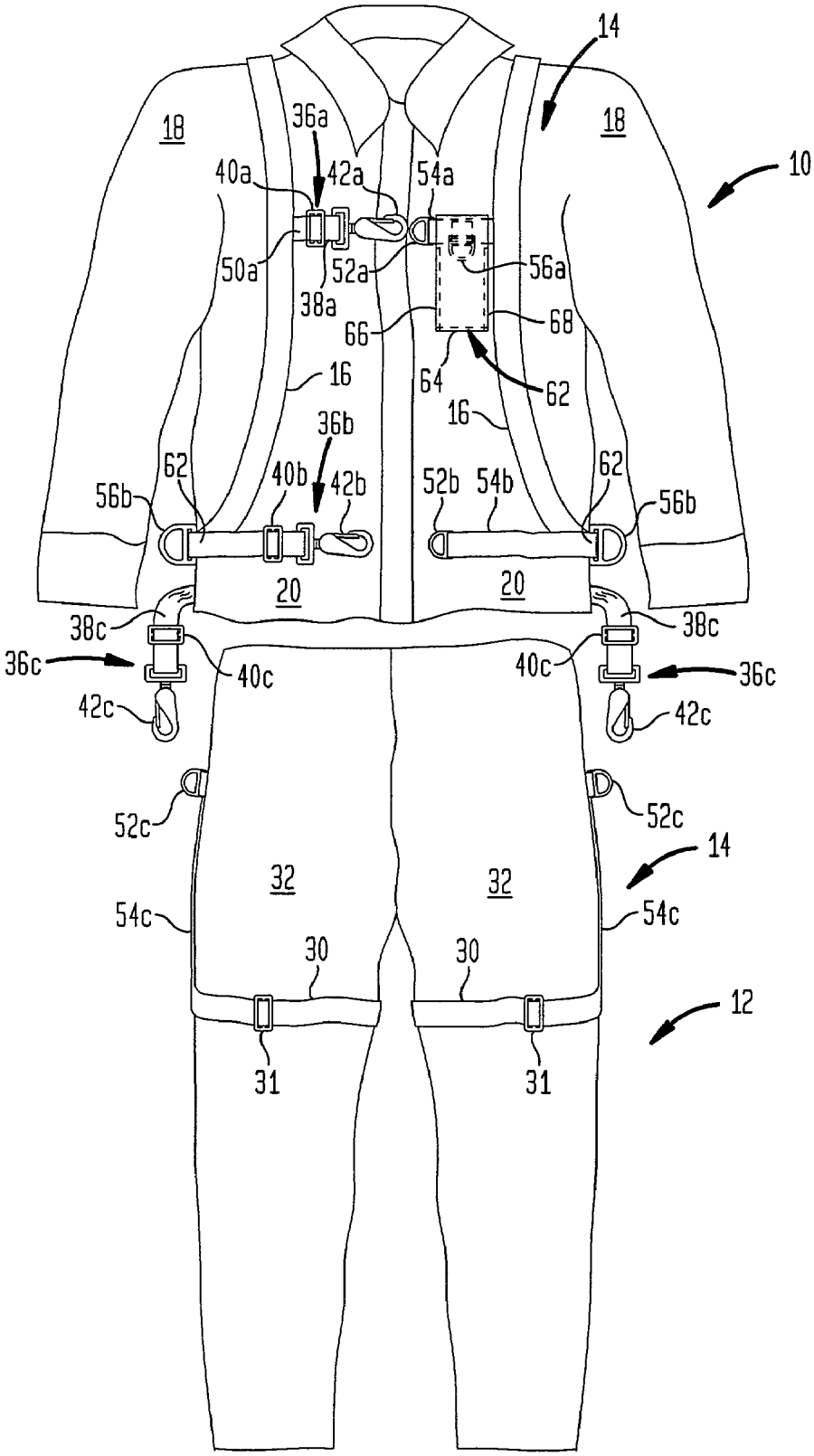
FIG. 1 is a front view of a turnout coat and pants with a built-in harness according to the present invention.
Figure 2:
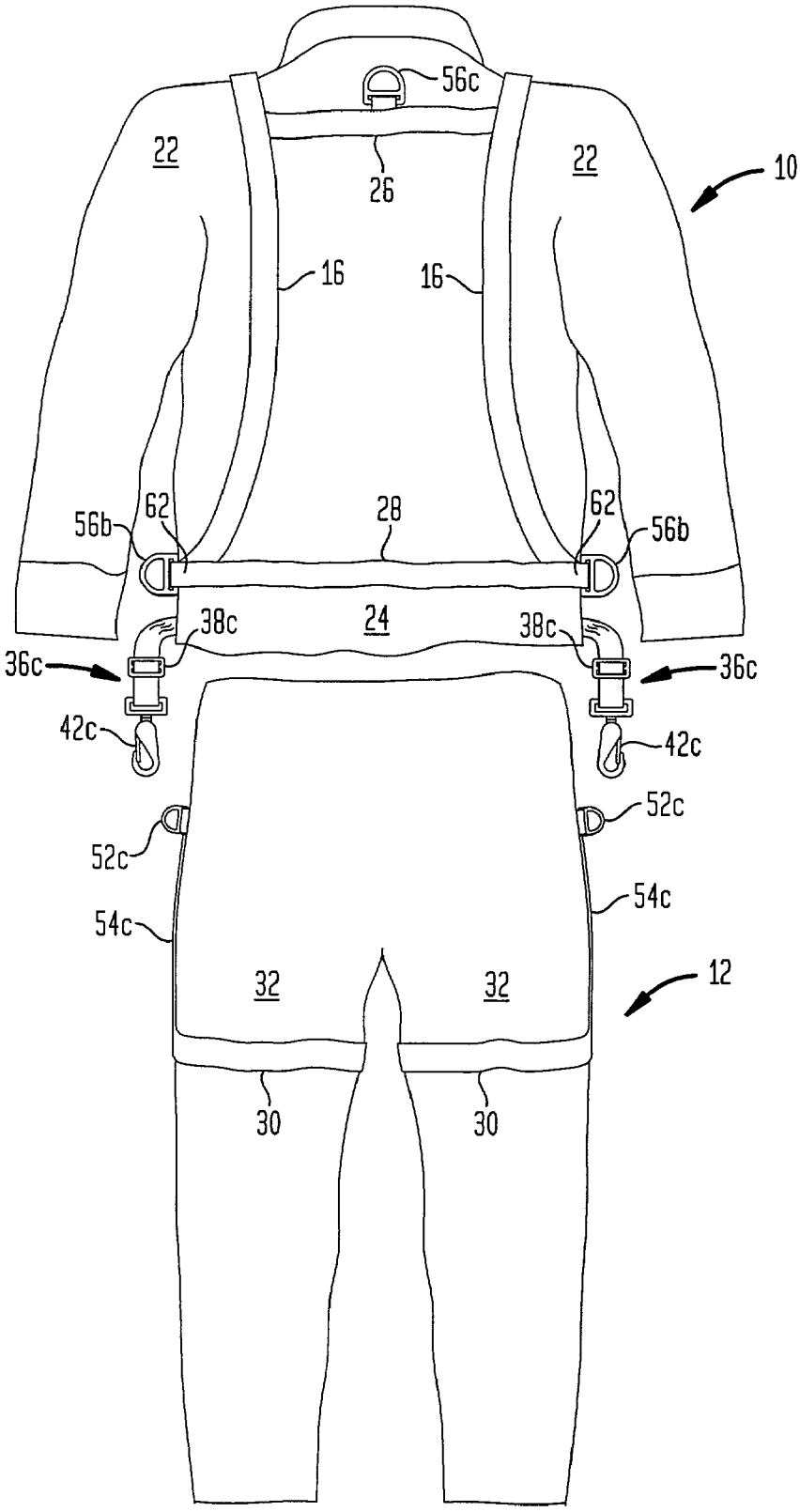
FIG. 2 is a back view of a turnout coat and pants with a built-in harness according to the present invention.
Figure 3:
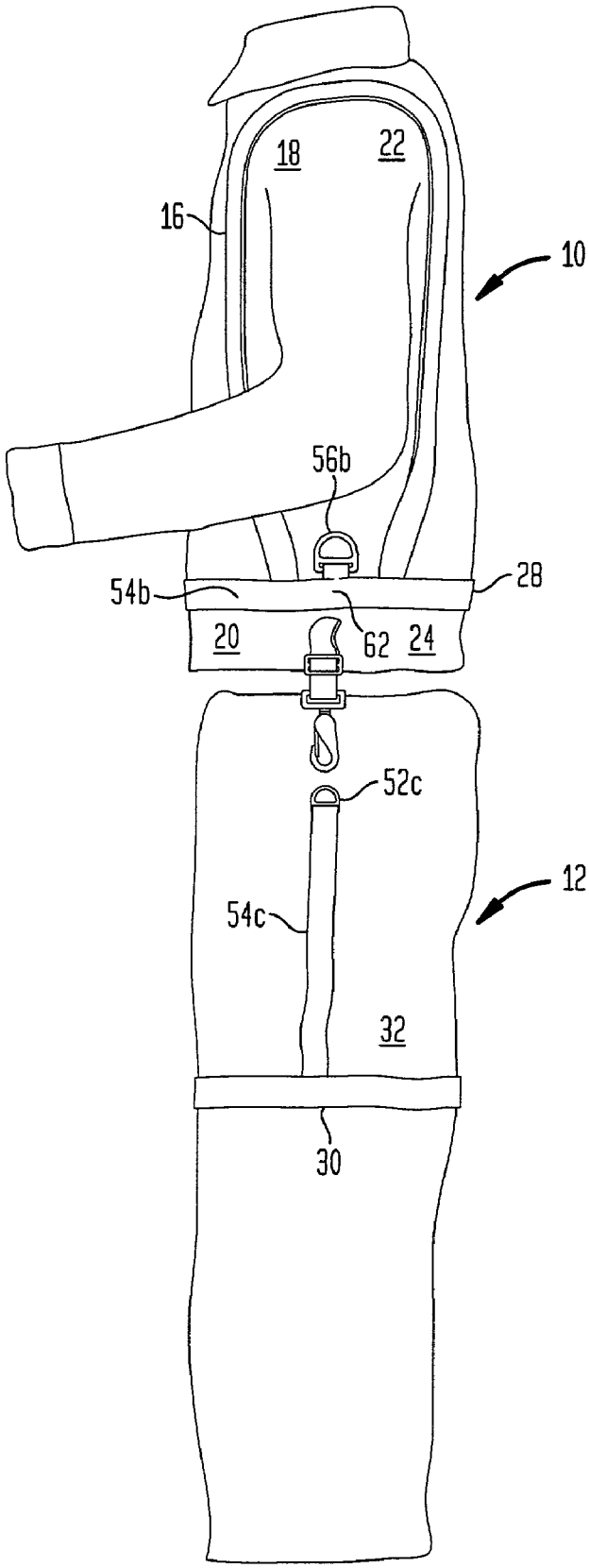
FIG. 3 is a side view of a turnout coat and pants with a built-in harness according to the present invention.

Referring to FIGS. 1–3, a turnout coat 10 and pants 12 with a built-in safety harness 14 is shown. In the preferred embodiment, the length of the turnout coat 10 is such that is goes to approximately the waistline of the wearer (not shown). Of course, the present invention also contemplates the use of a longer turnout jacket, such as a knee-length jacket. For such a jacket, some of the components may be attached on the inside of the jacket. The harness 14 may be permanently attached to the coat 10 and the pants 12 by stitching, glue, or some other appropriate permanent manner. Of course, the present invention contemplates the harness being attached to either the exterior or interior of the coat and pants. In addition, the present invention further contemplates the harness 14 being attached to other types of coats or shirts and pants, besides turnout gear. Thus, the present invention may include a work coat or work shirt and work pants that are not turnout gear and thus, not fire retardant. In such a case, the harness may be comprised of any type of webbing, including for example nylon webbing. In a preferred embodiment, the harness may be covered with a reflective material such as 3M SCOTCHLITE available from 3M.

In the preferred embodiment, the harness 14 comprises a pair of upper straps 16 connected to the front of the coat 10 from the shoulder area 18 to the waist area 20. The upper straps 16 continue around to the back of the coat and are attached from the upper back area 22 to the lower back area 24. An upper back strap 26 connects the pair of upper straps to each other across the upper back area 22. A lower back strap 28 connects the pair of straps to each other across the lower back area 24.

The harness 14 further comprises a pair of leg straps 30 attached around the front and back of a thigh area 32 of each leg. The leg straps 30 may be adjustable via adjustment slides 31. Of course, the present invention contemplates any suitable arrangement of the harness straps on the coat and pants.

Figure 4:
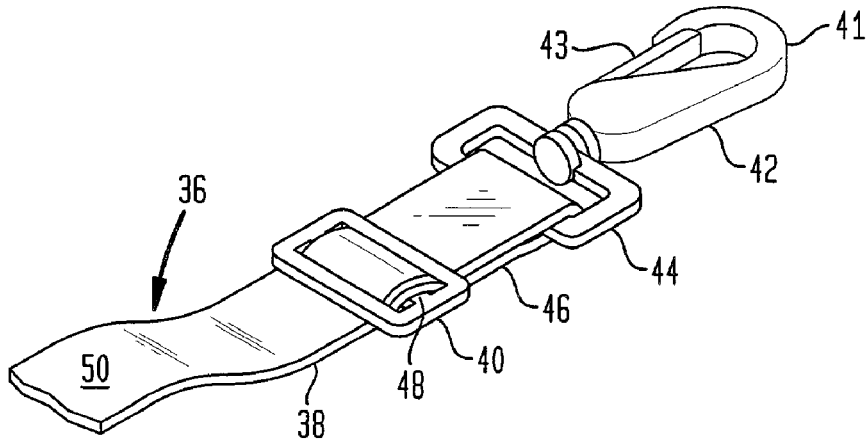
FIG. 4 is a perspective view of a locking clip assembly according to the present invention.
Figure 5:
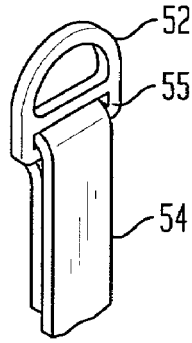
FIG. 5 is a perspective view of a small D ring according to the present invention.
Figure 6:
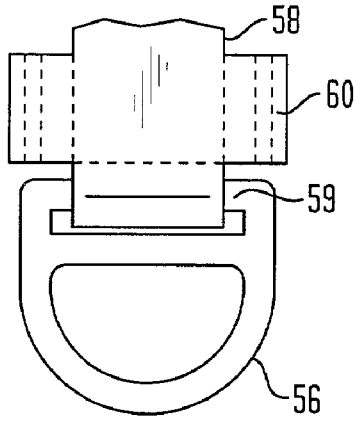
FIG. 6 is a front view of a large D ring according to the present invention.

FIGS. 4–6 show the preferable detail of the various clip and ring assemblies used in connection with the harness 14. FIG. 4 shows a locking clip assembly 36. The locking clip assembly 36 has a strap 38, an adjustment slide 40 and a locking clip 42. The locking clip 42 includes a hook member 41, a locking member 43, and a link 44 for attaching the locking clip 42 to the strap 38. The locking member 43 is pivotally attached to the hook member 41. Locking member 43 cannot pivot past the edge of the hook member 41.

A first end 46 of the strap 40 is attached a cross bar 48 of the adjustment slide 40. The strap 38 is woven through the adjustment slide 40 such that length of the strap 38 may be changed by sliding the adjustment slide 40 along the strap 38. A second end 50 of the strap is typically connected to some part of the coat or pants, as will be discussed below.

FIG. 5 shows a small D ring 52. The small D ring 52 also has a strap 54, which is coupled to the small D ring 52 by looping the strap 54 through a cross bar 55. The small D ring 52 may be used in combination with the locking assembly 36 to fasten parts of the coat and pants, as will be discussed below.

FIG. 6 shows a large D ring 56. A strap 58 is looped through a cross bar 59. The strap 58 has an attachment band 60 for attaching the large D ring to a part of the harness 14. The large D ring 56 is used for connecting the harness 14 to a safety line or equipment (not shown), as will be discussed below. Of course, the present invention contemplates any suitable connectors in lieu of all or a portion of the clip and ring assemblies discussed above.

Referring back to FIGS. 1–3, a locking clip assembly 36*a* and small D ring 52*a* are preferably attached to either of the upper straps 16 at the shoulder area 18. As shown in the Figures, the locking assembly 36*a* is connected to one of the upper straps via the second end 50*a* of the strap 38*a*. The small D ring 52*a* is attached to the other upper strap via its strap 54*a*. The locking clip 42*a* couples with the small D ring 52*a* in order to attach the upper straps together across the chest area. The adjustment slide 40*a* may be moved to adjust the length of the strap dependent upon the wearer of the coat. Also disposed on the strap 38*a* of the locking assembly 36*a* is a large D ring 56*a*. The large D ring 56*a* is used for connecting the harness 14 to a safety line, as will be discussed below.

Another locking assembly 36*b* and small D ring 52*b* are attached to the waist area 20 of the upper straps 16. The locking clip 42*b* couples with the small D ring 52*b*. The adjustment slide 40*b* may be moved to adjust the size of the strap dependent upon the wearer of the coat. There are a pair of large D rings 56*b* attached to a point 62 where the lower back strap 28, upper strap 16 and the locking assembly 36*b* or the strap 54*b* of the small D ring 52*b*. The large D rings 56*b* may be used for securing devices such as tools and rescue equipment (not shown) to the harness 14 to a safety line.

Preferably, a pair of locking assemblies 36*c* are also attached to the harness 14 at the point 62 via straps 38*c*. A pair of small D rings 52*c* are attached to the leg straps 30 of the harness via straps 54*c*. The locking clips 42*c* and the small D rings 52*c* are positioned so that they may be connected to couple the harness of the coat 10 to the harness of the pants 12 and therefore act as connectors connecting the coat 10 to the pant 12. Upon coupling, the adjustment slides 40*c* may be moved to adjust the lengths of the straps 38*c* so that the harness snuggly fits the wearer based upon his or her height.

A large D ring 56*c* is attached to the upper back strap 26. The large D ring 56 may be coupled to a safety line.

Figure 7:
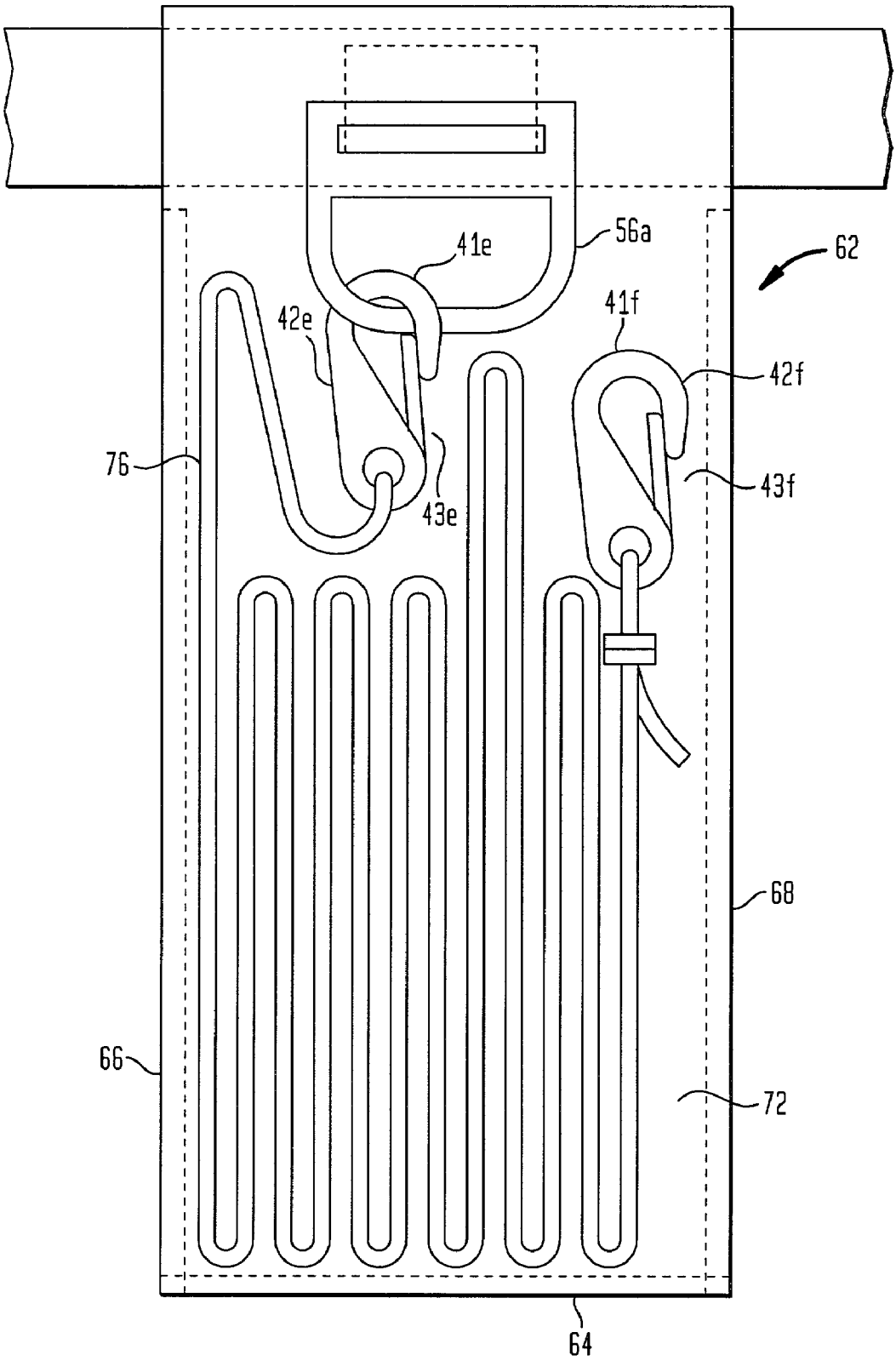
FIG. 7 is a front view of the interior of the pocket according to the present invention.

Referring now to FIGS. 1 and 7, the coat 10 further includes a pocket 62. The pocket is attached to the coat 10 around the area of strap 54*a* and is preferably made of the same material as the coat 10. The pocket 62 comprises one permanently attached bottom edge 64 which is permanently secured to the coat 10. Side edges 66 and 68 are releasably attached to the coat 10, for example via Velcro or some other easily releasable method. Top edge 70 may be either releasably attached to the coat 20 similar to side edges 66 and 68 or top edge 70 may be free from attachment with the coat 10. Thus, an interior 72 of the pocket 62 may be quickly accessed by detaching edges 66, 68 and 70 from the coat and allowing the exterior flap 74 to pivot about bottom edge 64.

Preferably, a safety line or tether line 76 is stored in the pocket 62. The tether line includes locking clips 42*e* and 42*f* attached at either end of the line. Locking clip 42*e* includes hook member 41*e* and locking member 43*e* and locking clip 42*f* includes hook member 41*f* and locking member 43*f*. Large D ring 56*a* is attached to the strap 54*a*. Thus, the safety line 76 is securable to the harness 14 at large D ring 56*a* via locking clip 42*e*. In order to secure the safety line to the large D ring 56*a*, the locking clip is simply pressed against the D ring at the locking member 43*e*. This causes the locking member to pivot inwardly so that the D ring gains access to the interior of the hook member 41*e*. Once in this interior region of the hook member 41*e*, the locking member pivots to its normally locked position against the interior of the hook member 41*e* as shown in FIG. 7. While being stored in the pocket 63, it is preferable that safety line is always secured to large D ring 56*e*. Free locking clip 42*f*, thus, may be secured when necessary for repelling, or other rescue work. Safety line 76 further includes an adjustment slide 78 to adjust the length of the line.

To utilize the turnout gear of the present invention, a wearer of the turnout coat and pants would couple each of the locking assemblies and small D rings 36*a* and 52*a*, 36*b* and 52*b*, and 36*c* and 52*c*. The coupling is accomplished with the locking clips 42*a*, 42*b*, and 42*c*. The small D rings 36 are pressed against the corresponding locking clips 42 at the locking members 43. This causes the locking members 43 to pivot inwardly to provide the small D rings 52 access to the interior of the hook members 41 of the locking clips. Then, the locking members 43 pivot back to their normal locked position against the interior of the hook member. The wearer could then move each adjustment slide 42*a*, 42*b*, and 42*c* for a snug fit of the harness, coat and pants. These steps to fit the harness are typically performed when the wearer initially dresses in the turnout coat and pants.

Then, during the course of rescue work in the field, when necessary, the safety line 76 may be accessed by the wearer by detaching pocket 62. Preferably the safety line 76 is already secured at one end to the harness at large D ring 56*a* via locking clip 42*e*. If not, the safety line may be quickly secured to large D ring 56*a* via locking clip 42*e*. The free end of the safety line may then be secured to an outside position for repelling or any other rescue or safety purpose. In addition, the safety line 76 of another person may be connected to the harness via each of the large D ring 56*b*. The large D rings 56*a* and 56*b* may be utilized simultaneously for safety lines or one may be used for a safety line while the others may be used to secure another person to the harness. The availability of the large D rings 56*a* and 56*b* increases the versatility of the harness 14. Moreover, devices such as tools and rescue equipment may be attached to any of the large D rings 56*a*, 56*b*, and 56*c* so that they are easily accessible to the wearer. If the wearer of the invention is not conscious, they large D-ring 56*c* may be used to attach the wearer to a safety line since it is easily accessible, allowing the unconscious person to be easily lifted or lowered to safety.

Of course the present invention contemplates that more or less large D rings may be connected to the harness for additional safety lines, attachment of equipment, or for other rescue purposes.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Protective clothing comprising:

a coat;

pants; and a safety harness having an upper portion attached to said coat, a lower portion attached to said pants, and a connector, said upper portion being connectable to said lower portion, said lower portion of said safety harness further comprising a first leg portion, said leg portion being attached to a leg of said pants at a front and back upper thigh area.

2. Protective clothing according to claim 1, further comprising an attachment for attaching devices to said harness.

3. Protective clothing according to claim 2, wherein said attachment comprises at least one D ring attached to at least one side of said coat.

4. Protective clothing according to claim 1, wherein said safety harness further comprises at least one adjustor operable to adjust the size of said harness.

5. Protective clothing according to claim 4, wherein said at least one adjustor comprises:

at least one adjustable strap having a first end and a second end, said at least one adjustable strap being connected to said upper portion at said first end;

a clip attached to said second end; and a ring attached to said upper portion opposite said adjustable strap, wherein said clip couples with said ring.

6. Protective clothing according to claim 1, wherein said upper portion of said safety harness further comprises first and second upper straps, each of said upper straps being attached to said coat from a front shoulder area to a front waist area and from an upper back area to a lower back area; and said lower portion of said safety harness further comprises a second leg portion, said second leg portion also being attached to a leg of said pants at a front and back upper thigh area.

7. Protective clothing according to claim 6, wherein said first and second leg straps are adjustable.

8. Protective clothing according to claim 6, wherein said upper portion of said safety harness further comprises:

an upper back strap connecting said first and second upper straps across said upper back area; and a lower back strap connecting said first and second upper straps across said lower back area.

9. Protective clothing according to claim 8, further comprising:

a first adjustable strap having first and second ends, said first adjustable strap being connected to said first upper strap at said first end;

a first clip attached to said second end;

a first ring connected to said second upper strap opposite said first adjustable strap, wherein said first adjustable strap couples with said first ring across said front shoulder area;

a second adjustable strap having first and second ends, said second adjustable strap being connected to said first upper strap at said first end;

a second clip attached to said second end; and a second ring connected to said second upper strap opposite said second adjustable strap, wherein said second adjustable strap couples with said second ring across said front waist area.

10. Protective clothing according to claim 9, wherein said connector comprises a plurality of D rings.

11. Protective clothing according to claim 10, wherein one of said plurality of D rings is attached to said upper back strap and another of said plurality of D rings is attached to said first adjustable strap.

12. Protective clothing according to claim 1, further comprising a safety line attached to at least one D ring attached to a first adjustable strap.

13. Protective clothing according to claim 12, wherein said attachment comprises said at least one D ring attached to at least one side of said coat.

14. Protective clothing according to claim 13, further comprising a pocket for storing said safety line, said pocket being partially releasably attached to said coat.

15. Protective clothing according to claim 14, wherein said pocket includes a first edge permanently attached to said coat, a second edge releasably attached to said coat, a third edge releasably attached to said coat and a fourth edge releasably attached or unattached to said coat.

16. Protective clothing according to claim 15, wherein said first and second leg straps are adjustable.

17. Protective clothing according to claim 1, wherein said harness is permanently attached to said coat and said pants.

18. Protective clothing according to claim 1, further comprising a safety line attached to said connector.

19. Protective clothing according to claim 18, wherein said safety line is releasably attached to said connector.

20. Protective clothing according to claim 19, further comprising a pocket for storing said safety line, said pocket being partially releasably attached to said coat.

21. Protective clothing according to claim 20, wherein said pocket includes a first edge permanently attached to said coat, a second edge releasably attached to said coat, a third edge releasably attached to said coat and a fourth edge releasably attached or unattached to said coat.

22. Protective clothing according to claim 1, wherein at least a portion of said harness is attached to an interior of said coat.

23. Protective clothing according to claim 1, wherein said coat and said pants comprise fire retardant material.

24. Protective clothing of claim 1, wherein at least a portion of the harness is permanently attached to said coat and said pants.

25. An adjustable safety harness attached to a coat and pants comprising:

first and second upper straps, each of said upper straps being attached to said coat from a front shoulder area to a front waist area and from a back shoulder area to a lower back area;

an upper back strap connecting said first upper strap to said second upper strap across said back shoulder area;

a lower back strap connecting said first upper strap to said second upper strap across said lower back area;

first and second adjustable leg straps, each of said leg straps being attached to a leg of said pants at a front and back upper thigh area, wherein said first and second adjustable leg straps are connected to said first and second upper straps, respectively;

a connector; and an attachment operable to attach devices to said safety harness.

26. An adjustable safety harness according to claim 25, further comprising:

a safety line attached to said connector; and a pocket for storing said safety line, said pocket being partially releasably attached to said coat.

27. An adjustable safety harness according to claim 26, further comprising:

at least one adjustable strap having first and second ends, said at least one adjustable strap being attached to said first upper strap at said first end;

at least one clip attached said second end; and at least one ring, wherein said at least one clip couples with said at least one ring and said connector is located on said at least one adjustable strap.

28. An adjustable safety harness according to claim 27, further comprising:

first and second adjustable connecting straps, each of said first and second adjustable connector straps having a first end and a second end, said first adjustable connector strap being attached at said first end to a first point where said first upper strap, said lower back strap and said first adjustable strap meet and said second adjustable connecting strap being attached at said first end to a second point where said second upper strap, said lower back strap and said second adjustable strap meet;

first and second clips attached to said second ends of said first and second adjustable connecting straps, respectively;

first and second bands, each of said first and second bands having first and second ends, said first band being attached to said first leg strap at said first end and said second band being attached to said second leg strap at said first end;

first and second rings, said first ring being attached to said second end of said first band and said second ring being attached to said second end of said second band, wherein said first clip couples with said first ring and said second clip couples with said second ring.

29. An adjustable safety harness according to claim 28, wherein said connector is a D ring.

30. An adjustable safety harness according to claim 29, further comprising a plurality of additional D rings.

31. The adjustable safety harness according to claim 30, wherein at least one of said plurality of additional D rings is attached to said upper back strap.

32. An adjustable safety harness according to claims 26, further comprising:

a first adjustable strap having first and second ends, said first adjustable strap being connected to said first upper strap at said first end and having said connector located thereon;

a first clip attached to said second end;

a first ring connected to said second upper strap opposite said first adjustable strap, wherein said first adjustable strap couples with said first ring across said front shoulder area;

a second adjustable strap having first and second ends, said second adjustable strap being connected to said first upper strap at said first end;

a second clip attached to said second end; and a second ring connected to said second upper strap opposite said second adjustable strap, wherein said second adjustable strap couples with said second ring across said front waist area.

33. The adjustable safety harness according to claim 28, wherein said attachment comprises at least one D ring is attached to said first point and at least one of D ring attached to said second point.

34. The adjustable safety harness according to claim 28, wherein said harness is permanently attached to said coat and said pants.

35. The adjustable safety harness according to claim 25, wherein said coat, said pants and said harness comprise fire retardant material.

36. The adjustable safety harness according to claim 35, wherein said harness is covered with reflective material.

37. The adjustable safety harness according to claim 25, wherein said harness comprises webbing.

38. The adjustable safety harness according to claim 37, wherein said webbing is nylon webbing.

39. The adjustable safety harness according to claim 37, wherein said harness is covered with reflective material.

40. An adjustable safety harness permanently attached to fire retardant coat and pants comprising:

first and second upper straps, each of said upper straps being attached to said coat from a front shoulder area to a front waist area and from a back shoulder area to a lower back area;

an upper back strap connecting said first upper strap to said second upper strap across said back shoulder area;

a lower back strap connecting said first upper strap to said second upper strap across said lower back area;

first and second leg straps, each of said leg straps being attached to a leg said pants at a front and back upper thigh area;

a first adjustable strap having first and second ends, said first adjustable strap being connected to said first upper strap at said first end;

a first clip attached to said second end;

a first ring connected to said second upper strap opposite said first adjustable strap, wherein said first adjustable strap couples with said first ring across said front shoulder area;

a second adjustable strap having first and second ends, said second adjustable strap being connected to said first upper strap at said first end;

a second clip attached to said second end;

a second ring connected to said second upper strap opposite said second adjustable strap, wherein said second adjustable strap couples with said second ring across said front waist area;

first and second adjustable connecting straps, each of said first and second adjustable connector straps having a first end and a second end, said first adjustable connector strap being attached at said first end to a first point where said first upper strap, said lower back strap and said first adjustable strap meet and said second adjustable connecting strap being attached at said first end to a second point where said second upper strap, said lower back strap and said second adjustable strap meet;

first and second connecting clips attached to said second end of said first and second adjustable connecting straps, respectively;

first and second adjustable bands, each of said first and second bands having first and second ends, said first band being attached to said first leg strap at said first end and said second band being attached to said second leg strap at said first end;

first and second connecting rings, said first connecting ring being attached to said second end of said first band and said second connecting ring being attached to said second end of said second band, wherein said first clip couples with said first connecting ring and said second clip couples with said second connecting ring;

a plurality of D rings, at least one of said plurality of D rings being attached to said upper back strap, and at least one of said plurality of D rings being attached to said first adjustable strap;

a safety line attached to said D ring attached to said first adjustable strap;

a pocket for storing said safety line, said pocket having a first edge permanently attached to said coat, a second edge releasably attached to said coat, a third edge releasably attached to said coat and a fourth edge releasably attached or unattached to said coat; and a plurality of D rings for attaching devices to said harness wherein at least one of said plurality of D rings is attached to said first point, at least one of said plurality of D rings is attached to said second point.

41. Protective clothing of claim 1, wherein said connector is releasable.

42. Protective clothing according to claim 2 wherein said connector is conectable to said attachment.

43. Protective clothing according to claim 2 wherein the attachment is on the upper portion of said harness.

* * * * *

UNITED STATES PATENT AND TRADEMARK OFFICE

CERTIFICATE OF CORRECTION

PATENT NO. : 7,047,567 B2
APPLICATION NO. : 10/099011
DATED : May 23, 2006
INVENTOR(S) : Douglas L. Allen It is certified that error appears in the above-identified patent and that said Letters Patent is hereby corrected as shown below:

Title page, Item (57) under Abstract, line 2, “built in” should read --built-in--.
Title page, Item (57) under Abstract, line 5, “pant” should read --pants--.
Col. 2, line 29, “may me” should read --may be--.
Col. 3, line 10, “is shown” should read --are shown--.
Col. 3, line 56, “attached a cross” should read --attached to a cross--.
Col. 5, line 8, “safety line is” should read --safety line 76 is--.
Col. 5, line 46, “they large D-ring” should read --the large D-ring--.
Col. 7, line 67, “attached said second” should read --attached to said second--.
Col. 8, line 36, “claims 26,” should read --claim 26,--.
Col. 8, line 57, “D ring is attached” should read --D ring attached--.
Col. 9, line 18, “leg said pants” should read --leg of said pants--.
Col. 10, line 37, “conectable” should read --connectable--.

Signed and Sealed this

Twenty-sixth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,047,567 B2
APPLICATION NO. : 10/099011
DATED : May 23, 2006
INVENTOR(S) : Douglas L. Allen It is certified that error appears in the above-identified patent and that said Letters Patent is hereby corrected as shown below:

Title page, Item (57) under Abstract, line 2, “built in” should read --built-in--.
Title page, Item (57) under Abstract, line 5, “pant” should read --pants--.
Col. 2, line 29, “may me” should read --may be--.
Col. 3, line 10, “is shown” should read --are shown--.
Col. 3, line 56, “attached a cross” should read --attached to a cross--.
Col. 5, line 8, “safety line is” should read --safety line 76 is--.
Col. 5, line 46, “they large D-ring” should read --the large D-ring--.
Col. 7, line 67, “attached said second” should read --attached to said second--.
Col. 8, line 36, “claims 26,” should read --claim 26,--.
Col. 8, line 57, “D ring is attached” should read --D ring attached--.
Col. 9, line 18, “leg said pants” should read --leg of said pants--.
Col. 10, line 37, “conectable” should read --connectable--.

Signed and Sealed this

Ninth Day of January, 2007

JON W. DUDAS
*Director of the United States Patent and Trademark Office*